US007387542B1

(12) United States Patent
Kero

(10) Patent No.: US 7,387,542 B1
(45) Date of Patent: Jun. 17, 2008

(54) HDMI CONNECTOR

(75) Inventor: Mirza Kero, Laredo, TX (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 11/810,848

(22) Filed: Jun. 7, 2007

(51) Int. Cl.
*H01R 24/00* (2006.01)

(52) U.S. Cl. ..... 439/660

(58) Field of Classification Search ..... 439/607, 439/456, 632, 495–496, 470, 732, 595, 492, 439/752

See application file for complete search history.

(56) References Cited

U.S. PATENT DOCUMENTS 6,027,363 A * 2/2000 Watt et al. ..... 439/456
6,123,570 A * 9/2000 Hwang ..... 439/456
6,793,537 B2 * 9/2004 Stefaniu et al. ..... 439/660
6,932,640 B1 8/2005 Sung
7,059,914 B2 6/2006 Tsai
7,192,310 B1 3/2007 Chao et al.
2005/0255752 A1 11/2005 Huang
2006/0148319 A1 7/2006 Huang

FOREIGN PATENT DOCUMENTS

DE 20 2005 004 433 U1 6/2005

* cited by examiner

*Primary Examiner*—Jean F Duverne
(74) *Attorney, Agent, or Firm*—Miller Patent Services; Jerry A. Miller

(57) ABSTRACT

A pin and base plate construction within an HDMI connector that guards against pin damage or misalignment that results in the disruption of electrical signals within the HDMI connector. A hooked end of a pin is inserted into an inset hole aligned with a channel within the base plate. While the body of the pin lies flat within the channel, the pin end hooked into the hole in the base plate resists push or pull forces on the pin, thus limiting damage and eliminating misalignment of the pins. This abstract is not to be considered limiting, since other embodiments may deviate from the features described in this abstract.

12 Claims, 3 Drawing Sheets

HDMI CONNECTOR

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

HDMI (High Definition Multimedia Interface) connectors, like many electrical connectors, utilize pins to provide electrical contact to allow transmission of HDMI information between devices. HDMI connectors have become a standard for use in high definition television connectivity applications and are widely accepted in the marketplace. HDMI supports standard, enhanced, or high-definition video, plus multi-channel digital audio over a single cable. HDMI is usable for transporting all ATSC HDTV standards along with 8-channel, 192 kHz, uncompressed digital audio compressed audio formats. For purposes of this document, the term HDMI is intended to embrace all current and future standard connectors for HDMI interfaces.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

DETAILED DESCRIPTION

Figure 1:
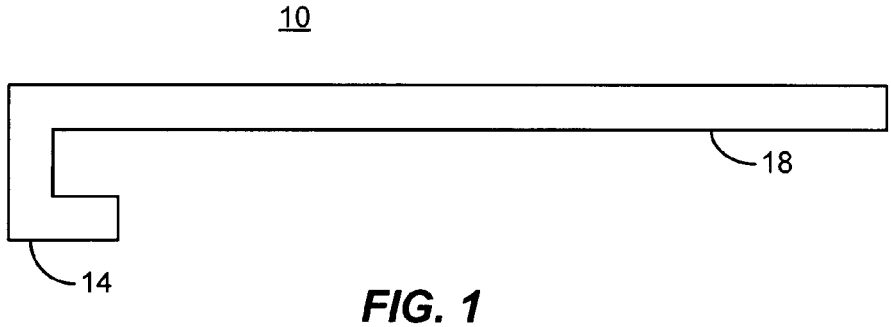
FIG. 1 is a connector consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

It has been noted that these connectors are quite prone to failure. Occasionally, pins within such electrical connectors may become damaged or misaligned. Certain embodiments that address these issues are presented in the following disclosure.

Frequently, the forcible insertion of an HDMI connector into a connector receptacle will result in one or more of the pins that establish and maintain the electrical connection to be pushed back out of the connector or become bent, twisted or misaligned. In these instances, the damage or misalignment of the affected pins can result in severance of the electrical signal normally carried by these pins or shor circuiting of electrical connections. Certain embodiments are herebelow described to address the issues of pin damage or misalignment within HDMI connectors.

Figure 2:
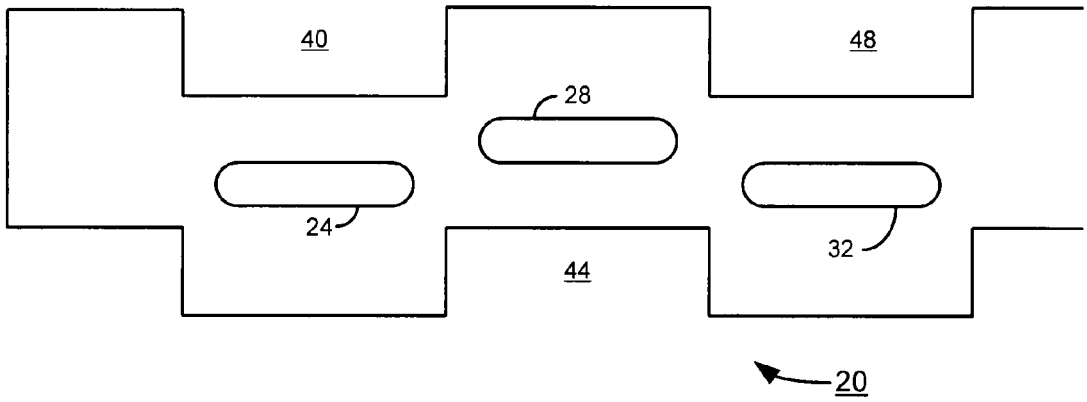
FIG. 2 illustrates an improved pin configuration used with the Connector of FIG. 1.

Turning now to FIG. 1 viewed in conjunction with FIG. 2, these figures presenting a connector assembly including an electrically conductive pin 10 having a straight shank 18 and a front end 14 that is bent through two approximately 90 degree angles to provide a hook shaped end 14. In other embodiments, other shapes may be used to provide a hook-like end including rounded hook shapes or other shapes that do not strictly have a pair of 90 degree bends. So long as the shape provides the hooking action that is described, it shall be considered hook shaped for purposes of the present discussion. Also presented in these figures is a portion of an end view of the central base plate 20 within an HDMI connector that has channels (three depicted—40, 44, 48) for the insertion of pins 10 with hook shaped front ends 14, and inset holes (24, 28, 32) aligned with these channels (40, 44, 48). Base plate 20 is made of an electrically insulative material such as plastic or other insulative material to provide insulation and isolation between the electrically conductive pins. Each inset hole (24, 28, 32) is aligned such that the hook shaped front end 14 of each pin 10 rests within one of each of the inset holes (24, 28, 32) providing for correct alignment, a secure connection, and resistance against dislodgement from the channels (40, 44, 48). The inset holes may, in fact, be fabricated as recessed areas that so not necessarily pass fully through the base plate 20, which will similarly be referred to has holes for purposes of this discussion.

Figure 3:
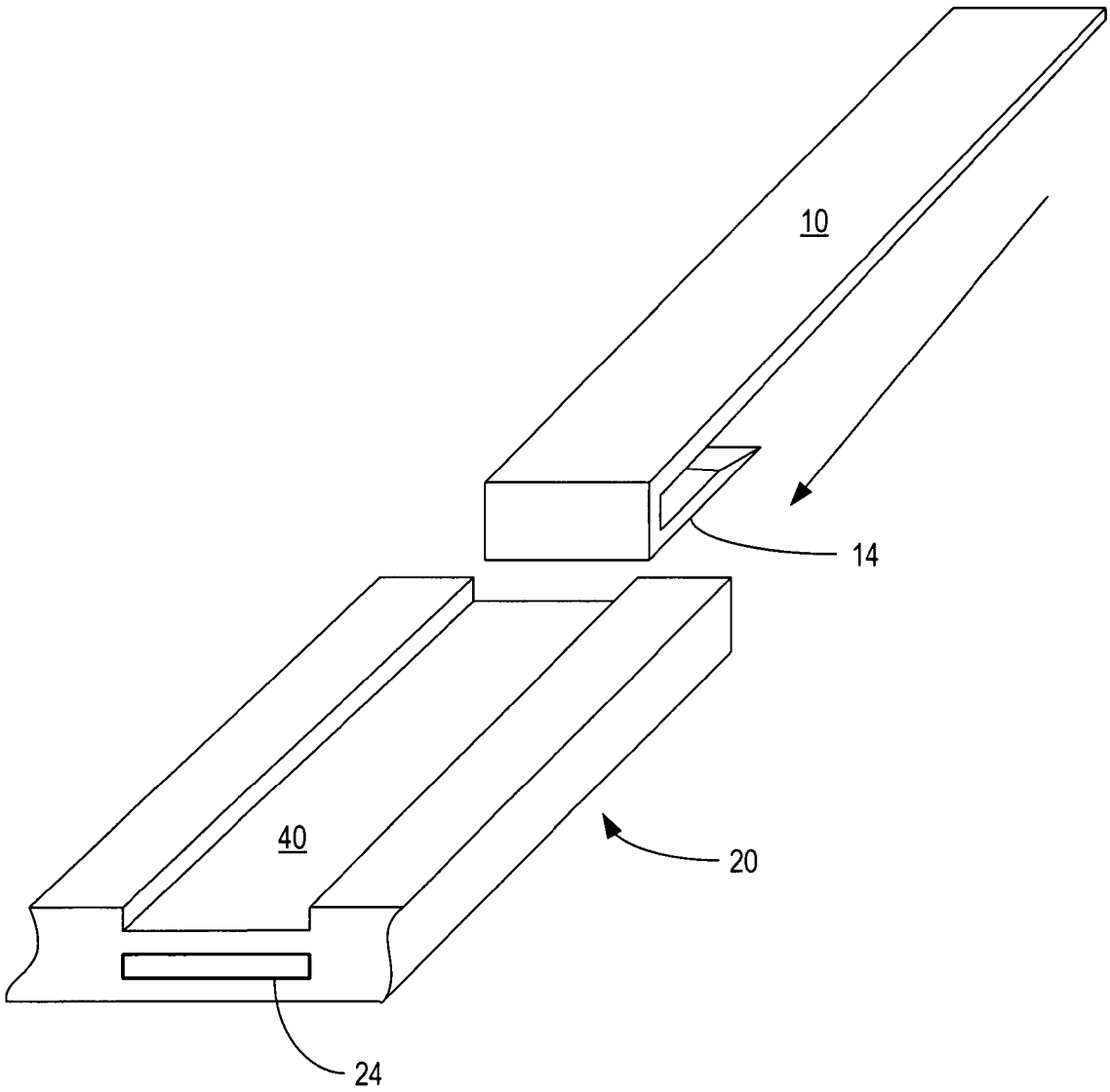
FIG. 3 is a pin insertion into a connector view consistent with certain embodiments of the present invention.

Turning now to FIG. 3, the figure presents the view of a pin 10 as it is inserted into a channel 40 configured within the base plate 20 of the HDMI connector. The pin 10 is inserted from the front end of the base plate 20 and will lie flat within the channel 40. The hook end of the pin 14 is inserted into the hole 24 configured at the end, and aligned with, the channel 40.

It is noted that in the depiction of FIG. 1, as shown, the pin 10 has a shaft 18 that is straight, however, the shaft 18 may be extended beyond the straight portion shown to include appropriate bends to facilitate interconnection with a circuit board in any number of configurations without departing from embodiments consistent with the present invention.

Figure 4:
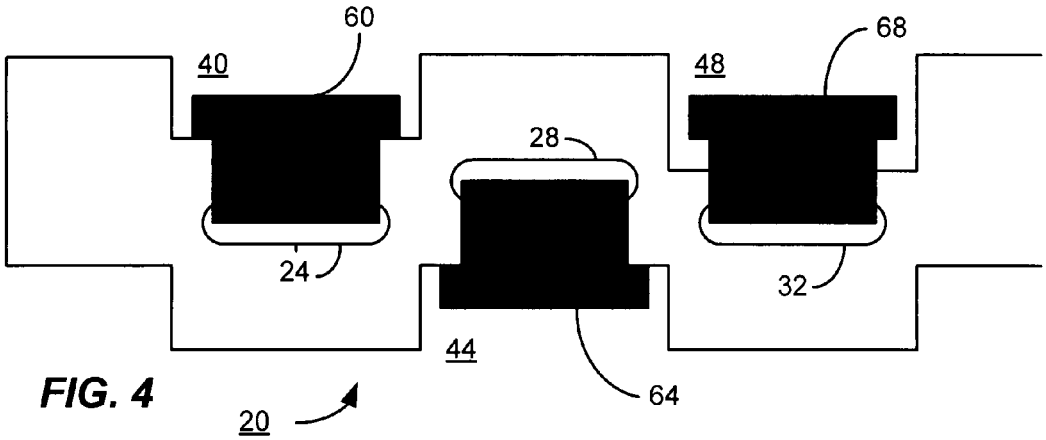
FIG. 4 is a pin set within connector channels view consistent with certain embodiments of the present invention.

Turning now to FIG. 4, the figure presents an end view of the base plate 20 with three pins (60, 64, 68) fully inserted into the channels (40, 44, 48) and with the pins securely inserted into the holes (24, 28, 32) configured at the end of each channel (40, 44, 48) configured in the end of the base plate 20.

Figure 5:
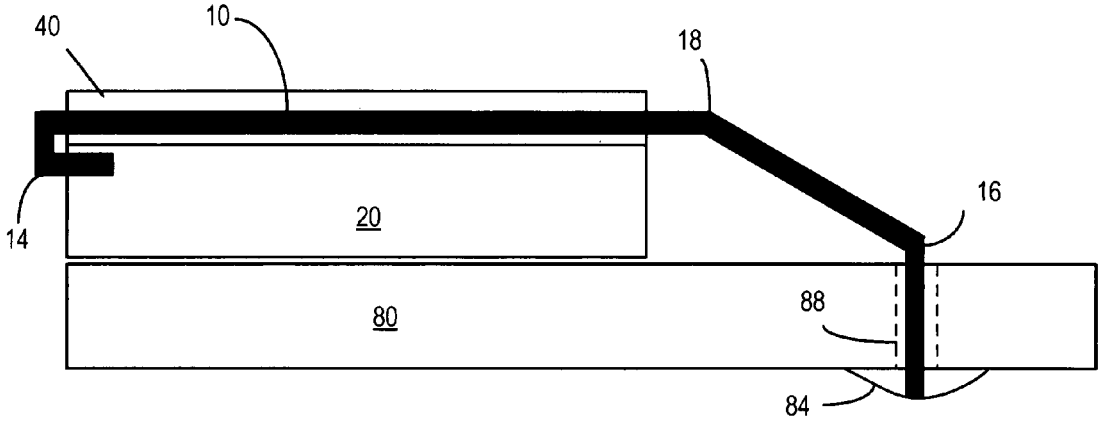
FIG. 5 is a cutaway view of a pin fully inserted and connected to a circuit board consistent with certain embodiments of the present invention.

Turning now to FIG. 5, the figure presents a cutaway view of the base plate 20 and a view of a channel 40 within the base plate with a pin 10 fully inserted within the channel 40. The straight shank of the pin 18 lies within the channel 40 when the hook-shaped end 14 is inserted into an inset hole 24 configured at the end below the channel 40. The opposite end of the pin 16 is suitably bent to allow a connection with a circuit board 80, in this case soldered at solder joint 84 to a plated through-hole on circuit board 80, to establish an electrical connection with the pin 10. In other embodiments, the pin can be bent in other configurations including configurations that are flattened near to end to act as a surface mount soldering surface.

In certain embodiments consistent with the invention, this insertion of a pin 10 into a hole 40 in the base plate 20 provides a secure electrical connection for signals that will be passed between devices through the use of a pin 10. This configuration also guards against a pin 10 being pushed back out of the base plate 20 and severing this electrical connectivity or causing a short circuit, as well as secures the pin 10 against any misalignment such as the lifting of a pin or any other such misalignment that severs electrical connectivity. Such damage is common in existing designs wherein the act of insertion and removal of a mating connector pushes the pin backward and otherwise misaligns the pin.

Additionally, consistent with certain embodiments, this arrangement of pin 10 and base plate 20 serves to secure a pin 10 against any pulling strain placed upon the pin 10 from the opposite direction as the force that causes a pin 10 to be shoved out of the base plate 20 or misaligned in any way. Consistent with this embodiment, the arrangement serves to protect the HDMI connector against damage or misalignment from forces in either direction as they might occur.

Thus, in accordance with certain embodiments consistent with the present invention, an apparatus has an electrically insulative connector base unit and a plurality of electrically conductive pins, each pin having one hook-shaped end. A plurality of channels are disposed within the base unit for slideably inserting the pins. An inset hole is provided in the base unit at a distal end of each channel, wherein the hook-shaped end of each pin is installed into the inset hole at the distal end of each channel when the pin is fully inserted.

A pin and base plate construction as depicted within an HDMI connector guards against pin damage or misalignment that results in the disruption of electrical signals within the HDMI connector. A hooked end of a pin is inserted into an inset hole aligned with a channel within the base plate. While the body of the pin lies flat within the channel, the pin end hooked into the hole in the base plate resists push or pull forces on the pin, thus limiting damage and eliminating misalignment of the pins.

While certain illustrative embodiments have been described, it is evident that many alternatives, modifications, permutations and variations will become apparent to those skilled in the art in light of the foregoing description.

What is claimed is:

1. An Apparatus comprising:

an electrically insulative connector base unit;

a plurality of electrically conductive pins, each pin having one hook-shaped end;

a plurality of channels within said base unit for slideably inserting said pins, comprising a first channel cut in the top surface of said base unit, a second channel cut in the bottom surface of said base unit and successive channels cut in alternating top surface and bottom surface positions;

an inset hole associated with each channel in said base unit within a distal endface of the base unit, each inset hole in alignment with the distal end of each channel;

wherein the hook-shaped end of each pin is installed such that a short arm of said hook-shaped end is extended past the distal endface of said base unit and each short arm of said hook-shaped end of the pins is inserted into the inset hole at the distal end of each channel when said pin is fully inserted.

2. An apparatus as in claim 1 further comprising:

said connector comprises an HDMI connector.

3. An apparatus as in claim 2 further comprising:

said connector base unit forms the interior portion of an HDMI connector.

4. An apparatus as in claim 1 further comprising:

each pin comprises a first end and shank portion that are substantially flat, and a second end that is bent to form a hook shape.

5. An apparatus as in claim 4 further comprising:

wherein the hook-shaped end is bent through two approximately 90 degree angles to form said hook-shaped end.

6. An apparatus as in claim 4 further comprising:

each pin is of sufficient length to extend the entire length of said electrical connector base unit when fully inserted.

7. An apparatus as in claim 6 further comprising:

each pin rests within one of said channels when said pin is fully inserted.

8. An apparatus as in claim 1 further comprising:

wherein the plurality of pins are configured at an end opposite the hook-shaped end for connection to a circuit board.

9. An apparatus as in claim 1 further comprising:

wherein said plurality of pins are secured within said inset holes to provide strain relief against pull forces for said pins when fully inserted.

10. An apparatus as in claim 8 further comprising:

the end of said pins that is at the opposite end of the pin shank from the hook-shaped end comprises a bend.

11. An apparatus as in claim 10 further comprising wherein said bend is sufficient to place the pin end in contact with a circuit board to establish an electrical connection.

12. An apparatus comprising:

an electrically insulative electrical connector base unit forming an interior portion of the HDMI connector;

a plurality of electrically conductive pins, each pin having one hook-shaped end and another end configured for correction to a circuit board;

a plurality of channels within said base unit for slideably inserting said pins, comprising a first channel cut in the top surface of said base unit, a second channel cut in the bottom surface of said base unit and successive channels cut in alternating top surface and bottom surface positions;

an inset hole associated with each channel in said base unit at a distal endface of the base unit, each inset hole in alignment with the distal end of each channel;

wherein the hook-shaped end of each pin is installed such that a short arm of said hook-shaped end is extended past the distal endface of said base unit and each short arm of said hook-shaped end of the pins is inserted into the inset hole at the distal end of each channel, and wherein each pin comprises a first end and a shank portion that are substantially flat, and a second end that is bent through two approximately 90 degree angles to form a hook shape that hooks into the inset hole in the base, and wherein each pin is of sufficient length to extend the entire length of said electrical connector base unit when fully inserted, and wherein each pin rests within one of said channels when said pin is fully inserted.

* * * * *